US007938938B2

(12) United States Patent
Beckmann et al.

(10) Patent No.: US 7,938,938 B2
(45) Date of Patent: May 10, 2011

(54) ELECTROLYSIS CELL

(75) Inventors: Roland Beckmann, Lünen (DE); Karl Heinz Dulle, Olfen (DE); Frank Funck, Mülheim (DE); Randolf Kiefer, Bochum (DE); Peter Woltering, Neuenkirchen (DE)

(73) Assignee: Uhdenora S.p.A., Milan (IT)

( * ) Notice: Subject to any disclaimer, the term of this patent is extended or adjusted under 35 U.S.C. 154(b) by 1172 days.

(21) Appl. No.: 11/628,626

(22) PCT Filed: Jun. 16, 2005

(86) PCT No.: PCT/EP2005/006498
§ 371 (c)(1),
(2), (4) Date: Dec. 5, 2006

(87) PCT Pub. No.: WO2005/123983
PCT Pub. Date: Dec. 29, 2005

(65) Prior Publication Data

US 2007/0240978 A1 Oct. 18, 2007

(30) Foreign Application Priority Data

Jun. 16, 2004 (DE) ..... 10 2004 028 761

(51) Int. Cl.
*C25B 9/00* (2006.01)
*C25C 7/00* (2006.01)

(52) U.S. Cl. ..... 204/242; 204/252; 204/257; 204/263; 204/627

(58) Field of Classification Search ..... 204/242, 204/252, 257, 263, 627
See application file for complete search history.

(56) References Cited

U.S. PATENT DOCUMENTS 4,639,303 A 1/1987 Staab et al.
4,664,770 A 5/1987 Schmitt et al.
5,194,132 A * 3/1993 Hartmann et al. ..... 204/257

FOREIGN PATENT DOCUMENTS

DE 196 41 125 A1 4/1998

* cited by examiner

*Primary Examiner* — Harry D Wilkins, III
*Assistant Examiner* — Zulmariam Mendez
(74) *Attorney, Agent, or Firm* — Charles A. Muserlian

(57) ABSTRACT

Electrolysis cell in the constructive form of single elements, intended for instance for the production of chlorine, hydrogen and/or caustic soda and designed in such a way that the portion of inactive membrane surface is minimised thanks to an optimised flange type so that the ratio between the flange surface of a semi-shell and the active membrane surface can be set to less than 0.045, neither the semi-shells nor the membrane being provided with bores or recesses for accommodating the clamping members.

9 Claims, 3 Drawing Sheets

PRIOR ART

ELECTROLYSIS CELL

Figure 1:
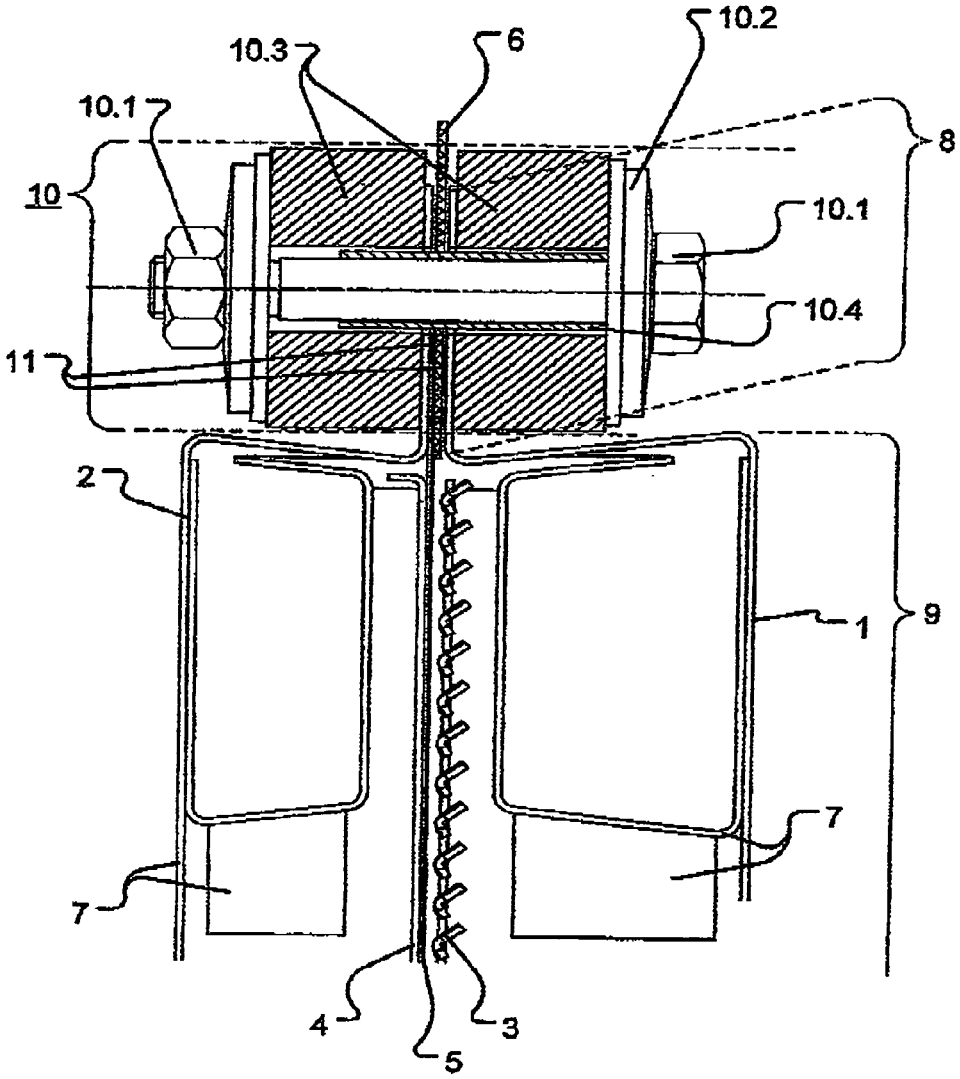

This application is a 371 of PCT/EP2005/006498 filed Jun. 16, 2005.

The invention relates to an electrolysis cell having the constructive form of the single element, the so-called "single cell elements", said cells being exploited for example for the production of chlorine, hydrogen and/or caustic soda solution etc. and designed in such a manner that the portion of inactive membrane surface is minimised with the aid of an optimised flange construction so that the ratio between the semi-shell flange surface and the active membrane surface is adjustable to <0.045 and neither the membrane nor the semi-shells are provided with bores or recesses for passage of the clamping members.

Electrolysis cells for the production of elemental chlorine, hydrogen and/or caustic soda solution are well known and their state-of-the-art design has been described sufficiently. In the conventional state-of-the-art technology, the use of two types of cell is widespread in industrial applications: one of the filter press design and the other of the said electrically series-connected "single cell elements".

These electrolysis cells such as described in DE 196 41 125, DE 197 40 637 or DE 196 41 125 consist inter alia of one cathodic and one anodic semi-shell which accommodate the anode or cathode, respectively, each having a different surface structure. The ion-exchange membrane is arranged between the electrodes and reaches far beyond the semi-shell flanges. The said semi-shell flanges are sufficiently sized to ensure an adequate pressure surface in order to avoid damage to the ion-exchange membrane.

According to the conventional state of the art, the semi-shell flanges and the membrane placed in-between are provided with bores or openings for safe positioning and fixing of the membrane, so that one bolted clamping member is provided for each bore or opening. The seal pressure acting on the semi-shells by means of the bolting is transferred via washer-type insulation elements placed on either side of the semi-shell flanges.

In accordance with the known state of the art a multitude of such clamping members are placed on the flange circumference of a single cell in order to ensure tightness of the cell and an almost uniform seal pressure on the membrane.

A major disadvantage of this prior-art electrolysis device is the fact that more than 10% of the ion-exchange membrane is inactive and does not take part in the electrolysis process as the membrane is enclosed by the flange or even extends beyond the flange to facilitate the assembly and because this very expensive material is merely utilised to position said item during the assembly of the single cell and to enhance the mechanical stability during operation.

The aim of the invention is to eliminate or minimise the inconvenience described above and to provide for an optimisation of the surface area utilisation of the membrane.

The aim of the invention is achieved by making the whole flange of the whole electrolysis cell smaller, omitting bores and recesses normally required for the passage of the bolting, the ratio between the semi-shell flange surface area overlapping the membrane and the active membrane surface area being less than 0.09 or preferably less than 0.07 or in an ideal embodiment less than 0.045.

According to an ideal embodiment of the electrolysis cell as specified in this invention the membrane is shaped in such a manner that it has neither bores nor recesses which normally serve to position the membrane in one or in both semi-shells or to pass the clamping members.

The said device also has clamping members which are applied to the external side of the flange or slipped onto the latter and which serve to clamp and seal the anodic and cathodic semi-shells to form a single element.

In an advantageous embodiment of the invention the said clamping members are individually bolted elements. An ideal variant is to use clamp-type or bolted gibs as elements for fixing the semi-shells, the said elements being available on the market as prefabricated elements. Further shapes of the said elements are suitable for this purpose provided they have at least two parallel and opposite insulation elements that are pressed against the flanges of the semi-shells.

Moreover, the electrolysis cell described in this invention comprises a device which permits that only a part of the insulation elements arranged on the side facing the flange of the semi-shell is directly supported by the said flange, a part of the surface areas protruding from the flange. At least one spacer is arranged between the insulation element faces that are not supported or one or both insulating elements are shaped in such a manner that either the spacer itself or in conjunction with the other insulating members fills the gap located in the area above the flange. An insulation body shaped in this manner is provided with, for example, protruding or cantilevered parts in the surface area facing the flange.

An advantageous embodiment of the invention provides for a spacer with a thicker and a thinner section and upon assembly the thicker part protrudes from the flange and the thinner section is clamped together with the membrane between the flange of the semi-shells. An embodiment of the variant described above provides for a spacer the protruding section of which has bores or openings that can accommodate bolts or clamps. In this case the thickness of the spacer section protruding from the flange approximately corresponds to the thickness of the flange after assembly, i.e. the thickness of the components inserted for the operation is included.

The essential advantage, hence, is a substantial reduction of the inactive membrane surface area while the size of the active membrane area remains unchanged.

A further important advantage in addition to the increased ratio of the active membrane is the fact that the overall membrane surface area becomes smaller and the membrane packaging is facilitated. It is imperative that any membrane bore or opening be made prior to assembly. The bored membrane types should be provided with bores prior to assembling, a step, which is now eliminated. This step always represented danger for the membranes, as damages or pollution of the coating or the base material of the membrane could never be completely excluded.

The reduction of the flange size also permits the semi-shells to be fabricated off semi-finished products such as coils, which can be purchased in standard size on the world market, a procedure which was not possible up to now. Hence, two substantial and positive effects could be realised with regard to material costs of the semi-shells, namely a simplified procurement and a reduced size.

Enclosed are a figure which illustrates a typical "single cell element" of the present state of the art and two figures which show an electrolysis device in accordance with the invention, further embodiments or variants being feasible.

The cross-sectional view in FIG. 1 shows an electrolysis cell segment in accordance with the present state of the art. Said view clearly illustrates the anodic semi-shell 1 and the opposite cathodic semi-shell 2, anode 3 and cathode 4. Semi-shells 1 and 2 exhibit two sections, a wall 9 and a circumferential flange 8. Flange 8 has holes for fixing the clamping element 10, through which bolt 10.1 is inserted. Said clamping element also encompasses a spring washer 10.2, which keeps the seal pressure constant, a detail required to compensate the variation of the material characteristics due to different swelling conditions of the membrane. Two annular insulation elements 10.3 are in direct contact with the metallic surface of flange 8 and, hence, with the semi-shells, said elements serving to transfer the forces. Moreover, bolt 10.1 located in the area of the flange neck is inserted into insulation hose 10.4. Membrane 5 is arranged between anode 3 and cathode 4.

The figure illustrates that membrane 5 is sized such that it extends beyond the section that accommodates the bores for the clamping elements. In a manner similar to that of the flanges, the membrane is also provided with openings in this section. Flange 8 is equipped with a flat spacer and insulation element 6 that constitutes a frame and that is likewise provided with bores correlated with the bores of flange 8. Two circumferential sealing cords 11 arranged between the semi-shells in the area of flange 8 ensure the tightness of the semi-shells. Internals 7 shown in FIGS. 1, 2 and 3 serve to ensure a calm flow in the upper part of the cell.

Figure 2:
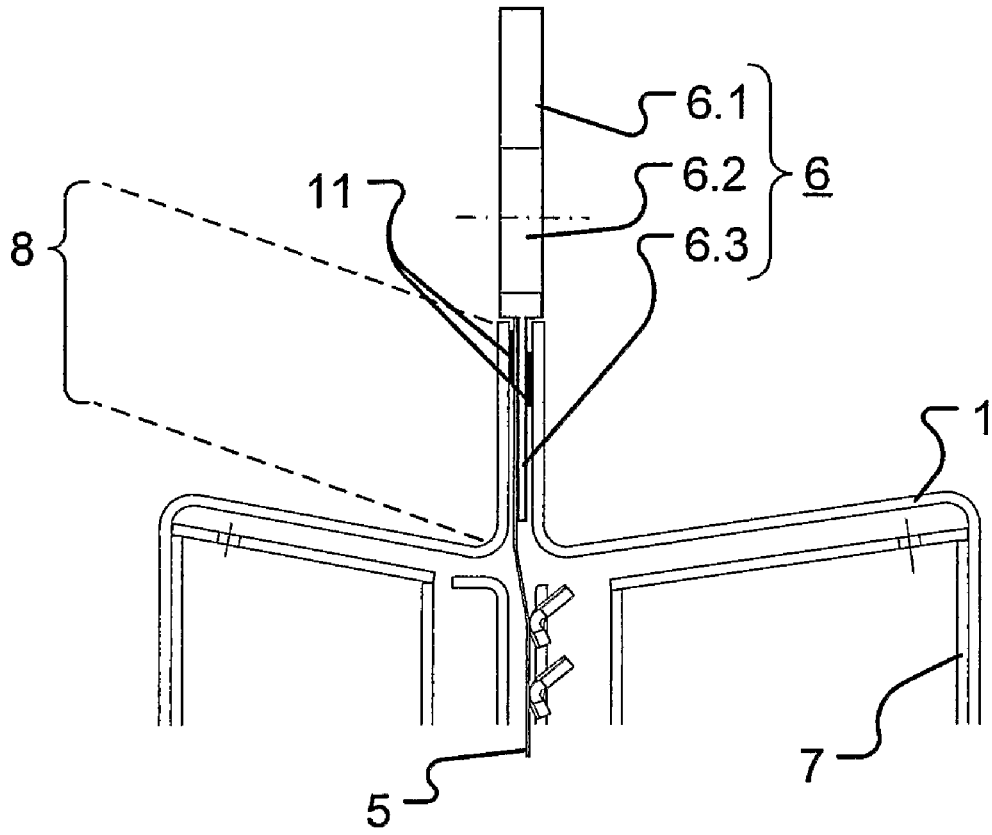

FIG. 2 shows the electrolysis cell of the invention without the clamping device. Flange 8 is considerably smaller-sized and has neither holes nor bores. Spacer variant 6 shown here protrudes from flange 8 and its upper part that extends beyond flange frame 6.1 is provided with bores 6.2 into which bolts 10.1 of one clamping element are inserted. The internal part of spacer 6, i.e. clamping area 6.3, is located between the flange parts of semi-shells 1 and 2. In this case insulation hose 10.4 that protects bolts 10.1 as shown in FIG. 1 can be omitted because the bolt cannot come into contact with the flange.

Figure 3:
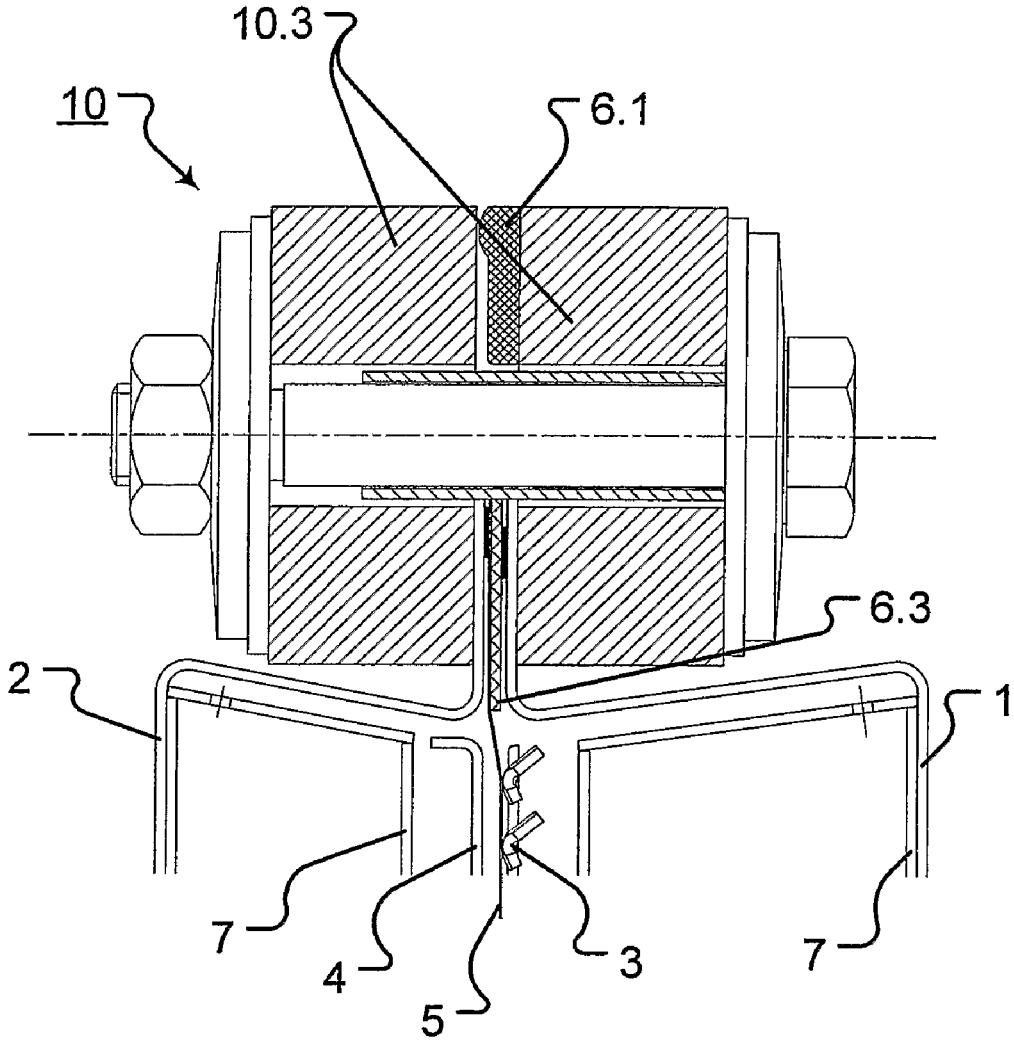

FIG. 3 shows the electrolysis cell of the invention with the attached clamping and sealing member 10, frame 6.1 and clamping area 6.3 of spacer 6 consisting of two separate pieces which are not firmly linked with each other.

As a variant it is possible to shape one or both insulation elements in such a manner that they have a protruding and a cantilevered part and the protruding part located in the upper part forms the spacer itself. This variant, however, is not shown in the figures.

It becomes evident that the device in accordance with the invention permits not only a smaller membrane surface area which increases the portion of the active membrane surface but also a certain degree of freedom in the design of the clamping device and its matching elements thanks to the omission of bores.

Two electrolysis cells as specified in the invention were tested in a test bench under genuine production conditions for a period of 5,000 operating hours. Two industrial electrolysis cells had an active membrane surface area of 2.72 $m^2$ each and a flange width of 15.5 mm and, hence, said surface area was more than 60% smaller than that of the state-of-the-art electrolysis cells. The cell voltage applied during the whole testing period was approx. 3.2 V at approx. 6 $kA/m^2$ current density and a cell temperature of about 90° C. The feed was 300 g per liter NaCl solution.

The caustic soda solution has an average discharge concentration of 32% with a NaCl residual concentration of <20 ppm. Moreover, gaseous $Cl_2$ and $H_2$ were produced, the average energy consumption being approx. 2,200 kWh per ton of NaOH.

During the whole testing period it was possible to obtain high conversion rates, product qualities, etc. by means of the single cells according to the present invention, i.e. the figures equalled those of the larger and more expensive state-of-the-art single cells with no disadvantages whatsoever with regard to the safety, tightness or maintenance.

The design features described in this invention permitted to reduce the portion of inactive membrane surface area from 11% obtained in the prior art technology to less than 4.2%.

The aim of the test series was to observe the membrane behaviour and deterioration as well as the single cell tightness because the membrane is subject to mechanical stresses generated by vibration and swelling or shrinking.

No anomalies were detected with regard to cell tightness and firm positioning of the membrane. During the whole testing period no operational problems or leakages were found and no adjustment or correction of the membrane or other components in order to avoid disturbances were required.

It was a surprise to find that the cell maintenance was facilitated and that the possibility of re-using a membrane already exploited in the process was substantially improved. This is due to the fact that upon opening a single cell, a membrane shrinking process is initiated, i.e. a criterion which formerly often caused tearing of the membrane material in the deteriorated sections near the bores and thus precluded a re-use of the membrane. As the electrolysis cell in accordance with the invention is placed in a horizontal position prior to opening, the membrane becomes free at once when a semi-shell is removed (no fixing) so that a subsequent uniform shrinkage cannot cause membrane deformation or damage.

It was also observed that the time required to assemble the single cells could be shortened because the membrane adjustment is now facilitated in view of the fact that no match with bores is necessary and the membrane ends only need be roughly flush with the flange edge. This alignment is of considerably lower importance because any deviation from being parallel with the edges is negligible.

Key to Reference Numbers

1 External semi-shell on anode side
2 External semi-shell on cathode side
3 Anode
4 Cathode
5 Membrane
6 Spacer
  6.1 Frame
  6.2 Bore
  6.3 Clamping area
7 Internals
8 Semi-shell flange
9 Elevated upper part of semi-shell
10 Clamping element
  10.1 Bolt
  10.2 Spring washer
  10.3 Insulation element
  10.4 Insulation hose
  10.5 Spacer
11 Sealing cord

The invention claimed is:

1. A single-cell type element for an electrolysis device delimited by two semi-shells, each provided with a back-wall and a peripheral flange whereon insulation elements are arranged and clamped by clamping elements fitted in a flange area, comprising two electrodes with a membrane placed therebetween, the semi-shells being free of bores or recesses for accommodating the bolting of the clamping elements and the ratio between the flange surface overlapping said membrane and the active membrane surface being less than 0.09.

2. The element of claim 1 wherein said ratio between the flange surface and the active membrane surface is less than 0.045.

3. The element of claim 1 wherein said membrane is free of bores or openings for its positioning in the semi-shells or for accommodating the bolting of the clamping elements.

4. The element of claim 1, wherein the clamping elements are slipped onto the flange or applied thereto.

5. The element of claim 1, wherein the clamping elements are designed as bolted single elements, clamp-type or bolted gibs or as any other type or shape, said elements having at least two parallel and opposite insulation elements that are pressed against the flanges of the semi-shells.

6. Tice element of claim 1, wherein only a part of the insulation elements arranged on the side facing the surface of the flange is directly supported by said flange, at least one spacer being fitted between the insulation element faces that are not supported or one or both insulation bodies being shaped in such a manner that they are provided with a protruding or cantilevered section, so that the gap located beyond said flange is at least partially filled.

7. The element of claim 6, wherein said at least one spacer has a thicker and thinner section protruding from the flange, the thinner section being clamped between the flanges of the two semi-shells together with said membrane.

8. The element of claim 7 wherein said spacer section protruding from the flange is provided with bores or openings.

9. The element of claim 6, wherein the thickness of said spacer protruding from the flange or of said protruding or cantilevered material sections of the insulation element corresponds approximately to the thickness of the flange in the assembled state, comprehensive of the thickness of the inserted element.

* * * * *